US005744181A

United States Patent [19]

Sornay et al.

[11] Patent Number: 5,744,181

[45] Date of Patent: Apr. 28, 1998

[54] PACKAGING METHOD USING THERMOPLASTIC MATERIALS AND PACKAGE OBTAINED THEREBY

[75] Inventors: Jean Denis Sornay, Paris; Philippe Gomes Da Silva, Evry, both of France

[73] Assignee: W. R. Grace & Co.-Conn., Duncan, S.C.

[21] Appl. No.: 603,794

[22] Filed: Feb. 20, 1996

[30] Foreign Application Priority Data

Mar. 1, 1995 [EP] European Pat. Off. ..... 95102885

[51] Int. Cl.[6] ..... B29C 45/00; B29C 51/00; B65B 7/28; B65D 85/00

[52] U.S. Cl. ..... 426/106; 53/467; 53/478; 53/485; 264/328.1; 264/544; 426/129; 426/392

[58] Field of Search ..... 426/106, 129, 426/392; 264/328.1, 544; 53/452, 467, 478, 485

[56] References Cited

U.S. PATENT DOCUMENTS

| | | | |
|---|---|---|---|
| 3,639,318 | 2/1972 | Tijunelis et al. | 524/114 |
| 4,070,852 | 1/1978 | Mitchell et al. | 53/297 |
| 4,345,412 | 8/1982 | Balzer et al. | 53/297 |
| 4,357,288 | 11/1982 | Oas et al. | 264/40.6 |
| 4,532,189 | 7/1985 | Mueller | 428/516 |
| 4,548,824 | 10/1985 | Mitchell et al. | 426/111 |
| 4,551,380 | 11/1985 | Schoenberg | 428/218 |
| 4,617,241 | 10/1986 | Mueller | 428/520 |
| 4,724,185 | 2/1988 | Shah | 428/339 |
| 4,726,984 | 2/1988 | Shah | 428/216 |
| 4,735,855 | 4/1988 | Wofford et al. | 428/349 |
| 4,755,419 | 7/1988 | Shah | 428/220 |
| 4,828,928 | 5/1989 | Shah | 428/518 |

(List continued on next page.)

FOREIGN PATENT DOCUMENTS

| | | |
|---|---|---|
| 32 820 | 1/1981 | European Pat. Off. . |
| 87080 | 10/1983 | European Pat. Off. . |
| 141555 | 10/1984 | European Pat. Off. . |
| 206 826 | 6/1986 | European Pat. Off. . |
| 251769 | 6/1986 | European Pat. Off. . |
| 217596 | 9/1986 | European Pat. Off. . |
| 248 601 | 5/1987 | European Pat. Off. . |
| 338 488 | 4/1989 | European Pat. Off. . |
| 388177 | 3/1990 | European Pat. Off. . |
| 440 291 | 1/1991 | European Pat. Off. . |
| 457598 | 5/1991 | European Pat. Off. . |
| 2058240 | 6/1970 | France . |
| 1006466 | 3/1964 | United Kingdom . |
| 1199998 | 3/1969 | United Kingdom . |
| 1283742 | 8/1969 | United Kingdom . |
| 1392580 | 3/1973 | United Kingdom . |
| 2 120 199 | 4/1983 | United Kingdom . |
| 2221649 | 8/1988 | United Kingdom . |
| 91/17886 | 11/1991 | WIPO . |
| 95/16202 | 6/1995 | WIPO . |

OTHER PUBLICATIONS

Abstract of Japan 54–100,896 (Published Aug. 8, 1979).

*Primary Examiner*—Leo B. Tentoni
*Attorney, Agent, or Firm*—Mark B. Quatt

[57] ABSTRACT

The invention is a packaging method including providing a tray with heat-sealable rims; loading the tray with a product to be packaged; applying a lid on top of the tray, the tray rims and lid having contacting surfaces being made of materials which can be heat bonded to each other at a lid sealing station to effect sealing of the lid to the tray rims, the lid comprising a biaxially oriented heat-shrinkable film having a maximum shrink force, measured at the temperature in the lid sealing station during sealing, of 0.05 kg/cm in at least the transverse direction; and heat-sealing the lid to the tray rims. A modified atmosphere can be introduced between the lid and the tray. The invention is also a package including a product; a tray in which the product is placed, the tray having heat-sealable rims; and a lid heat-sealed to the tray rims, wherein the lid comprises a biaxially oriented heat-shrinkable film having a maximum shrink force of 0.05 kg/cm in at least the transverse direction.

20 Claims, 3 Drawing Sheets

U.S. PATENT DOCUMENTS

| | | | |
|---|---|---|---|
| 4,839,235 | 6/1989 | Shah | 428/516 |
| 4,847,148 | 7/1989 | Schirmer | 428/332 |
| 4,867,336 | 9/1989 | Stewart | 220/359 |
| 4,886,690 | 12/1989 | Davis et al. | 428/39.6 |
| 4,927,677 | 5/1990 | Kasai | 428/36.6 |
| 4,935,089 | 6/1990 | Schirmer | 156/272.6 |
| 5,004,647 | 4/1991 | Shah | 428/349 |
| 5,118,561 | 6/1992 | Gusavage et al. | 428/304.4 |
| 5,241,030 | 8/1993 | Barry et al. | 526/348.1 |
| 5,350,622 | 9/1994 | Speer et al. | 428/215 |
| 5,353,985 | 10/1994 | Nageli et al. | 229/123.1 |
| 5,402,622 | 4/1995 | Stockley, III et al. | 53/427 |
| 5,462,756 | 10/1995 | Raines et al. | 426/129 |
| 5,520,764 | 5/1996 | Toney et al. | 156/244.17 |
| 5,562,958 | 10/1996 | Walton et al. | 428/34.9 |

PACKAGING METHOD USING THERMOPLASTIC MATERIALS AND PACKAGE OBTAINED THEREBY

BACKGROUND OF THE INVENTION

The present invention refers to a method for packaging goods, particularly food products, with plastics materials and to the package thus obtained.

In the common practice, plastic material bases, such as thermoformed or injection moulded trays, are used in packaging goods, particularly in packaging food products. Once the product to be packaged is placed into the cavity provided by the tray, the package is closed by applying a plastic lid on top of the tray which is then heat sealed to the tray rims. In general terms, a web of plastics material is provided over the top of the tray containing the product in a lid sealing station which comprises a lower chamber and an upper chamber. The upper chamber includes a heated platen which may comprise one or more frames which, when the upper chamber and the lower chamber are closed together, press the lid(s) onto the rims or peripheral lips of the tray(s), in their turn supported by a similarly framed anvil, thus sealing them together.

The temperature at which the sealing frames are heated in order to seal the package depends on the machines and the materials used for the heat-sealing layers of both the tray and the lid. In general however temperatures between 110° and 160° C. are suitable for any type of heat-sealing layer. Typically however temperatures of between 120° and 140° C. are employed.

Suitable cutting means finally allow the separation of the trays and the removal of excess plastic material from the lidstock web.

SUMMARY OF THE INVENTION

In one aspect, a packaging method comprises providing a tray with heat-sealable rims; loading said tray with a product to be packaged; applying a lid on top of the tray, the tray rims and lid having contacting surfaces being made of materials which can be heat bonded to each other at a lid sealing station to effect sealing of the lid to the tray rims, the lid comprising a biaxially oriented heat-shrinkable film having a maximum shrink force, measured at the temperature in the lid sealing station during sealing, of 0.05 kg/cm in at least the transverse direction; and heat-sealing said lid to the tray rims.

In another aspect, a package comprises a product; a tray in which the product is placed, the tray having heat-sealable rims; and a lid heat-sealed to the tray rims, wherein the lid comprises a biaxially oriented heat-shrinkable film with a maximum shrink force of 0.05 kg/cm in at least the transverse direction.

BRIEF DESCRIPTION OF THE DRAWINGS

To better understand the present invention.

DESCRIPTION OF THE PREFERRED EMBODIMENTS

Still alternatively, but not shown in the attached drawings, the platen which descends to heat-seal the lidstock to the flat top lips of the trays is wholly heated. Particularly in this last case the plate is preferably covered with a non-sticky material such as a polytetrafluoroethylene (TEFLON® from DuPont) tape, to avoid the problem of sticking of the film to the heated platen.

Figure 1:
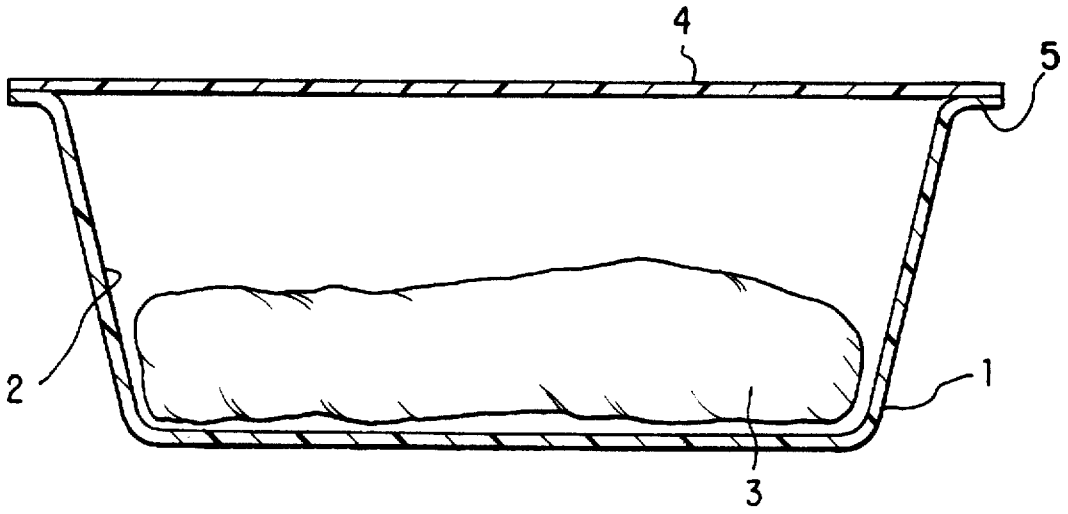
FIG. 1 is a diagrammatic side view of a package obtained by the method indicated above, wherein (1) is the tray, either thermoformed or preformed, (2) is the inner heat-sealable layer of said tray, (3) is the good which is loaded into the tray in order to be packaged therein, (4) represents the lid which is applied to the tray and sealed thereto, and (5) are the tray rims or flat top lips where the sealing occurs.
Figure 2:
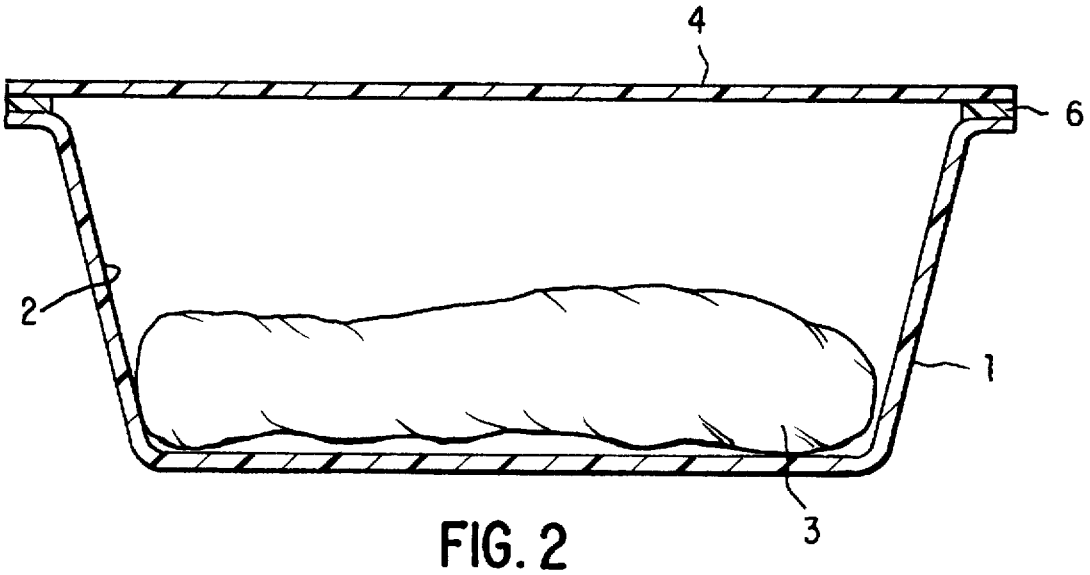
FIG. 2 is a diagrammatic side view of a slightly different type of packaging wherein the heat-sealable material in the tray (6) is present only on the tray rims.
Figure 3:
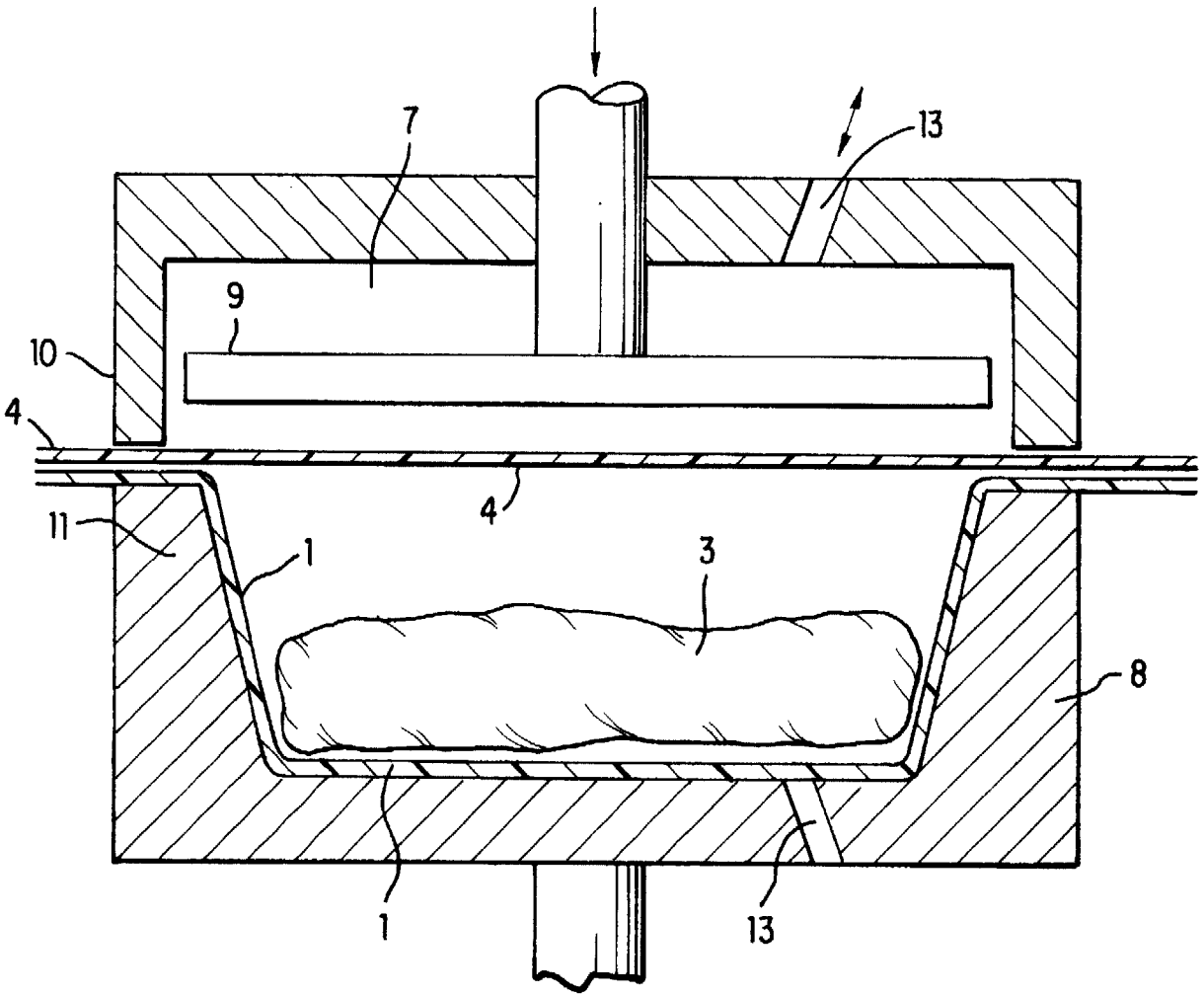
FIG. 3 is a side cross-sectional view of a lid sealing station wherein (1) is the heat-sealable tray, (3) is the good to be packaged, (7) is the upper chamber, (8) is the lower chamber, (9) is the upper mould, (10) is the heated frame and (11) is the support to the tray edges having the same shape as the heated frame (10). In this embodiment the upper mould (9) is heated by the transfer of heat from the heated frame (10)
Figure 4:
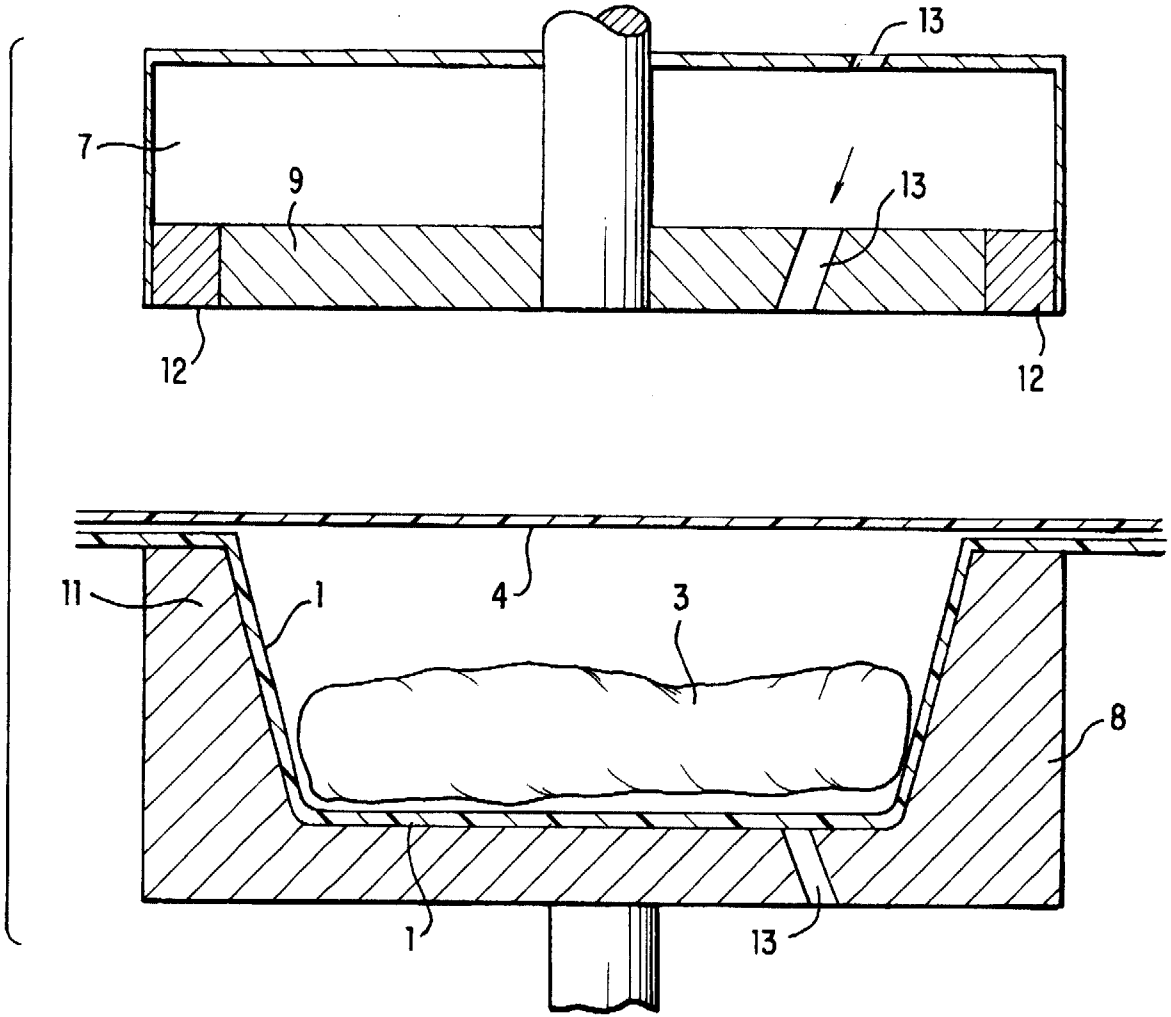
FIG. 4 is an alternative embodiment wherein the platen comprising the heated frames is replaced by a platen heated only around the tray edges (12).

In actual practice, when packaging food products, sometimes the air within the package is replaced by a suitable gas or gas mixture which is used to enhance the shelf life of the packaged goods (Modified Atmosphere Packaging). This may be an inert gas, typically nitrogen, or another gas which will enhance the keeping qualities of the goods, such as carbon dioxide, mixtures of two or more gases such as mixtures of carbon dioxide and nitrogen, of carbon dioxide and oxygen, or of oxygen, carbon dioxide and nitrogen in suitable proportions. This modified atmosphere can be obtained by flushing the desired gas between the lid and the tray in the lid sealing station prior and until the package is sealed. Alternatively, and preferably, the modified atmosphere is obtained by closing the upper and lower chambers together, evacuating air through suitable air passageways which are indicated in FIGS. 3 and 4 as (13), admitting the desired modified atmosphere into the closed upper and lower chambers so as to provide the desired modified atmosphere between the lid and the tray and then lowering the platen to seal the lid to the tray rims.

Other methods which can be considered as variations and improvements of the above general method are well known in the field of food packaging (see for instance British patents 1,199,998, and 1,392,580). In all these cases however the lid material, which is relatively thick, is typically obtained by extrusion or coextrusion of the selected polymer (s) or polymer blend(s) by conventional methods which do not involve any orientation of the obtained thermoplastics sheet (so-called "cast" extrusion or coextrusion).

Alternatively, the lid material is produced by methods which involve mono-axial or bi-axial orientation of the obtained sheet, but also a heat-setting step of the oriented product. Particularly in this latter case, the obtained film is then typically glue laminated to or coated with other materials to provide for e.g. the desired heat-sealability, or other desired properties.

In any case, up to now, heat-stability has been considered as an essential feature for the materials to be used as lidstock in this type of application. The use of a heat-stable material however presents some drawbacks. It is necessary to use relatively thick materials in order to preserve the appearance of the final package. If not thick enough, the lidding web would likely have a loose appearance and this would clearly have a negative impact on the package appearance. For this reason, laminates having a thickness of 80 to 120 micrometers are typically used as tray liddings. For some applications, and depending on the stiffness of the particular structure employed, thinner laminates can be used down to a thickness of 60 to 50 micrometers.

The need to use relatively thick laminates in its turn gives rise to a problem of optics and also of plastics waste disposal.

It has now been found that when a biaxially oriented heat-shrinkable film having a specific shrink behavior, in terms of shrink force, is employed as a tray lidding, packages with a particularly enhanced appearance are obtained. Suitable biaxially oriented heat-shrinkable films are those films which comprise at least a heat-sealable skin layer and are characterized by a maximum shrink force, at the temperature which is attained in the area of the lid-sealing station, not higher than 0.05 kg/cm in at least the transverse direction.

The temperature attained in the area of the lid sealing station causes a shrink of the sealed lid which keeps it tight on top of the tray. Little or no distortion of the tray will normally occur due to the limited shrink force in at least the transverse direction of the specific heat-shrinkable film employed. This will provide a better appearance to the package and allow a better visual inspection of the package content from the outside.

Furthermore, using thinner material (as thin as 10 to 15 micrometers) provides improved optics and reduced plastic waste.

The general processes conventionally used with the heat-stable lidstocks can be employed in the packaging method of the present invention. Also, the conventional lidding machines which are currently run with heat stable lidstocks can be used for this application, such as for instance the Ross Reiser, Caveco Automa, Caveco STL, Mecaplastic 2001, and Multivac T500 machines.

Preferably however when using a biaxially oriented heat-shrinkable film as the tray lidding, the lid web is cut after sealing and more preferably cutting occurs immediately after sealing while still in the lid sealing chamber.

To perform the process according to said preferred embodiment some of the available tray lidding machines may require a mechanical modification. It would also be possible to suitably modify an existing machine so as to provide that the heat-shrinkable lidding web is guided and held flat in tension until the exit of the sealed trays from the lid sealing station, or, when cutting of the excess lidstock web and separation of the trays is carried out in a separate contour trimming station, preferably until the trays are separated and the excess lidstock is removed. Modifications of the commonly available machines so as to better fit their use in conjunction with a heat-shrinkable lidstock can be easily carried out by applying conventional techniques.

The term "biaxially oriented" is used to define a polymeric material which has been heated and stretched in the longitudinal as well as in the transverse direction to align the macromolecule configuration.

The term "heat-shrinkable" film is intended to refer to a film that, when exposed at the temperature of 110° C. for five seconds, shrinks by at least 5% in both the transverse and longitudinal directions.

The biaxially oriented heat-shrinkable films to be used as tray liddings in the present invention are not required to have a very high free shrink at the temperature which is attained in the area of the lid sealing station. A free shrink of 5 to 10% in both directions would be more than sufficient to provide for the desired tight aspect of the lidding. However, in order to improve the appearance of the package, and reduce excess film in the sealing area (thus avoiding the so-called floppy borders), films with higher % free shrink are generally employed. Typically, biaxially oriented heat-shrinkable films used in the process of the present invention have a free shrink, at the temperature which is attained in the area of the lid sealing station, of at least 10%, preferably at least 15%, and more preferably at least 20%. More generally films with a % free shrink up to 60 to 70% at the temperature which is attained in the area of the lid sealing station can suitably be employed.

Biaxially oriented heat-shrinkable films as described aboye can be obtained for instance by the trapped bubble process developed by CRYOVAC® in the early sixties. In said process the polymer(s) or polymer blend(s) of the film layer or layers are extruded or co-extruded through a round die to give a primary tube. This is rapidly quenched, for instance by means of a water bath, then heated to a suitably selected temperature by hot water or air, and oriented in the transverse direction by internal air pressure, and in the longitudinal direction by a differential speed of the pinch-rolls which hold the trapped bubble. A tube is thus obtained of a film which has a reduced thickness with respect to the primary tube, whereas the ratio between the diameter of this tube and that of the primary tube is called transverse racking (or orientation) ratio, and the ratio between the speed of the pinch rolls which stretch the bubble with respect to that of the pinch rolls which keep the primary tube gives the longitudinal racking ratio.

In general, with this process racking ratios of typically between 1.5:1 and 5:1 are obtained, in both directions, depending on the material(s) employed.

Alternatively biaxially oriented heat-shrinkable multilayer films may also be obtained by extrusion coating wherein a primary tube of one or more layers is coated with the other layers which are either sequentially extruded or coextruded thereon in a single step and then oriented as indicated above. If desired the films may also be subjected to cross-linking treatments, generally by submitting them to energetic radiation treatments, typically by high energy electron treatment. In such a case irradiation is most preferably, but not necessarily, performed prior to orientation. In case such a treatment is applied, suitable radiation dosages of high energy, which are referred to herein in terms of the radiation units "Grays", with one thousand Grays being designated as "KGrays", may be in the range of up to 120 KGrays, more preferably from about 10 to about 90 KGrays. If only some of the layers of the film need to be irradiated, the irradiation step may be carried out on the first tube obtained in the two-step extrusion process, before the extrusion coating thereof.

An alternative method for the manufacture of biaxially oriented heat-shrinkable films as defined herein is by extrusion or co-extrusion through a fiat die over a chill roll (optionally followed by an extrusion- or co-extrusion-coating step) and stretching of the thus obtained thick sheet in the transverse and longitudinal directions by the so-called tenterframe technique. Stretching in the longitudinal direction is usually achieved by passing the sheet, heated at the suitably selected orientation temperature, through pairs of rolls which rotate at different speeds, while stretching in the transverse direction is performed in a tenterframe oven, heated to the suitably selected orientation temperature, which comprises suitable stretching means. Said stretching steps can be carried out sequentially or simultaneously.

The tenterframe technique is actually used industrially for the manufacture of heat-set structures by carrying out, after the orientation step, a heat treatment—called heat-setting—wherein the films, while restrained against shrinkage, are heated at a temperature above the glass transition temperature of the polymers and below their melting points to stabilize the molecules in the oriented state and eliminate completely the shrinkage.

Avoiding this heat-setting step, it is thus possible to obtain biaxially oriented heat-shrinkable films.

The stretching ratios in this case can be selected into a wider range as they may be up to 11:1 or even 12:1.

The thus obtained films, if not restrained from shrinkage, when heated will tend to shrink. This shrinking will be substantial, depending on the orientation ratios employed, at a temperature close to the orientation temperature but will become appreciable at much lower temperatures and will increase with the temperature.

The percent free shrink, i.e. the irreversible and rapid reduction, as a percent, of the original dimensions of a sample subjected to a given temperature under conditions where no restraint to inhibit shrinkage is present, has been measured according to ASTM method D 2732, by immersing for five seconds specimens of the structures (100 mm×100 mm) in a water or oil bath set at the temperature at which the shrink properties of the structure were to be evaluated, by means of a free shrink holder. The specimens were then removed from the bath, quickly immersed into a water bath at room temperature to cool them down and the linear dimensions of the specimens in both the longitudinal and transverse directions were recorded.

The percent free shrink is defined, for each direction, as: Unrestrained linear shrinkage, $\%=[(L_o-L_f)/L_o]\times 100$ wherein $L_o$ is the initial length of side and $L_f$ is the length of side after shrinking.

As indicated above, for the purpose of the present invention suitable films are those heat-shrinkable films that, when tested according to the ASTM method D-2732 at the temperature which is attained by the air or the modified atmosphere in the lid sealing station, show a free shrink of at least 5% in both directions.

Preferred heat-shrinkable films are however those showing a free shrink of at least 10%, preferably at least 15%, and more preferably at least 20% in both directions.

For the purpose of the present invention suitable heat-shrinkable films need to be characterized by a low shrink force. The shrink force, which is the force released by the material during the shrinking process, when referred to the structure cross-section is termed shrink tension. There is not a standard test method to measure this attribute. The method which has been used to evaluate this parameter is an internal method which is described herein below:

Specimens of the structure to be tested (2.54 cm×14.0 cm) were cut in the longitudinal and transverse directions and clamped between two jaws, one of which was connected to a load cell. The two jaws kept the specimen in the center of a channel into which an impeller blew heated air and three thermocouples measured the temperature. The signal supplied by the thermocouples was amplified and sent to an output connected to the "X" axis of an X/Y recorder: The signal supplied by the load cell was amplified and sent to an output connected to the "Y" axis of the X/Y recorder. The impeller started blowing hot air and the force released by the sample was recorded in grams. The temperature was increased up to a preselected maximum at a rate of 2° C./s. As the temperature increased the pen drew on the X/Y recorder the measured profile of the shrink force versus the temperature. The instrument produced a curve of shrink force (g) versus temperature (° C.); dividing the values thus recorded and multiplied by $10^{-3}$, by the specimen width (cm) the shrink force (in kg/cm) was obtained. By further dividing the shrink force by the specimen thickness (in cm), the shrink tension in kg/cm$^2$ was obtained at each given temperature.

It has been found that in order to avoid distortion of the most common trays on the market, the heat-shrinkable films to be used in the packaging method of the present invention should have, at the temperature which is attained by the air or the modified atmosphere in the lid sealing station, a shrink force not higher than 0.05 kg/cm at least in the transverse direction. As indicated above the polymer(s) and polymer blend(s) which can be employed in order to get heat-shrinkable films to be used in the packaging method of the present invention may vary widely as known in this field in order to provide the film with the desired mechanical, optical, and gas-permeability properties.

The desired shrink force characteristics of the heat-shrinkable films to be used as tray liddings in the process of the present invention might be obtained by suitably setting the key parameters in the manufacturing process (using low racking ratios, and/or high orientation temperatures), suitably selecting the polymers to be used and/or their sequence in the case of multilayer structures, reducing the shrink force of the available films by submitting them to a heat treatment under specific conditions, or by a combination of all these measures. Since, as indicated above, the shrink force also depends on the thickness of the structure, it may be possible to obtain a suitable structure having the shrink force characteristics below the above limits by reducing the thickness of otherwise unsuitable thicker structures.

The minimum thickness which can be used in the packaging method of the present invention will depend on other characteristics required by the package in the specific application, such as mechanical resistace, gas-permeability, if a gas barrier package is desired, the need for tie layers to improve the bond, etc. and will depend on the particular mono- or multilayer structure employed.

Films as thin as 10 micrometers can be employed, whereas balancing the several properties, heat-shrinkable films of an average thickness of from about 14 to about 40 micrometers, e.g. 15 micrometers, 19 micrometers, 25 micrometers, 30 micrometers, or 35 micrometers, are preferred.

Structures which may be employed in the packaging method and package of the present invention are for instance those described in U.S. Pat. No. 4,551,380, U.S. Pat. No. 4,532,189, EP-A-388,177, EP-A-457,598, GB-A-2,221,649, WO-91/17886 and EP-A-206,826 or, when a gas barrier layer is desired, in EP-A-217,596, EP-A-251,769, EP-A-87,080, EP-A-141,555, and PCT patent application no. PCT/US95/16202 filed on Dec. 15, 1995.

Modifications of the manufacturing conditions with respect to those indicated in the above patents can be made if necessary in order to get films with the requested shrink properties.

When a thermoformed tray is employed this will typically be made of a mono- or multilayer thermoplastic material which may be gas permeable or a gas barrier material and comprises a heat-sealable inner skin layer (6) or heat-sealable strips on at least the tray rims (7). Examples of gas permeable materials which can be used for the manufacture of thermoformed trays are e.g. multilayer laminates comprising a PVC layer and a polyethylene inner skin layer to provide the required heat-sealability, or in more general terms laminates comprising a PVC layer and an inner and optionally outer coating layer of any heat-sealable material which can heat-seal with the selected lid material.

Alternatively thermoformed gas permeable trays can be obtained by thermoforming polystyrene sheet, either foamed or unfoamed, having a surface layer of a heat-sealable thermoplastic and an intermediate bonding layer.

When a gas barrier thermoformed tray is desired this will typically be made of a multilayer structure comprising a gas barrier layer, such as for instance a layer comprising PVDC, EVOH, a poly- or copolyamide, etc. as known in this field, and at least the inner skin layer of a heat-sealable material. Other layers may clearly be present in order to provide the structure with the thickness and the mechanical properties required. Examples of barrier thermoformable structures are described for instance in U.S. Pat. No. 4,735,855.

Preferably however said gas barrier trays will be made by thermoforming a sheet of a surface layer of a heat-sealable thermoplastic, an internal layer of a gas-barrier or low oxygen transmission material, as seen above, a bonding layer and a layer of thermoformable plastic, typically polystyrene, either unfoamed or foamed (indicated as EPS). Examples of such gas-barrier trays are described for instance in U.S. Pat. No. 4,847,148 and U.S. Pat. No. 4,935,089.

The thermoformed trays can be made in-line or off-line. Alternatively pre-formed trays injection moulded trays can suitably be employed.

The preferred material in that case is still polystyrene, foamed or unfoamed, coated with a liner of a heat-sealable flexible film at least on the tray rims.

Also in this case, if a gas barrier tray is desired, the coating of the injection moulded polystyrene tray will comprise a gas-barrier intermediate layer and will cover the whole tray surface.

Dimensions and shape of the trays are not critical.

Suitable dimensions of the trays will depend on the dimensions of the products to be packaged. Also the shape of the trays may vary in order to provide the packaged items with a better or more characterising appearance. The dimensions of the tray rims is also not critical provided a sealing area of at least 2 mm, and preferably 3 mm is present to get a reliable seal.

The more flexible the material employed for the manufacture of the trays or the thinner its thickness, the more reduced should be the maximum shrink force developed by the heat-shrinkable lidding in the lid-sealing station in order to avoid tray distortion.

Therefore, in particular when thinner and/or more flexible trays are employed, a biaxially oriented heat-shrinkable film characterized by a maximum shrink force, at the temperature which is attained in the area of the lid-sealing station, not higher than 0.04 kg/cm in at least the transverse direction will preferably be employed in the process of the present invention. Still depending on the specific tray used, a biaxially oriented heat-shrinkable film characterized by a maximum shrink force, at the temperature which is attained in the area of the lid-sealing station, not higher than 0.03 kg/cm in at least the transverse direction might be even more preferably employed.

The most suitable shrink force limit for a given tray and a given packaging machine will however be easily determined by the person skilled in the art by trial and error.

The following specific examples are given to better illustrate the present invention but are not to be interpreted as a limitation to its scope.

EXAMPLE 1

Pre-formed thermoformed barrier trays about 225 mm in length, 170 mm in width, and 30 mm in depth (VITEMBAL) comprising an EPS substrate with an ethylene-vinyl alcohol copolymer as the barrier layer and a polyethylene heat-sealing layer (overall thickness of about 4 mm), are used on a MECAPLASTIC machine (MECA 2001). The trays are put on the infeed conveyor and filled with the products to be packaged. The machine is a 2-lane one, able to seal 4 trays per cycle and running at a speed of 8 cycles per minute.

The trays are then carried into the lid sealing station.

The heat-shrinkable film A (whose structure and characteristics are reported below) proceeds from an upward tensioned unwind unit along a fed path within this lid sealing station over the four packages that are positioned widthwise. The sealing mould is closed and vacuum is pulled up to the value set on the machine panel, then the suitable gas mixture is injected and the heated platen with the protruding knives descends to cut the heat-shrinkable lidstock about 3 mm far from the tray contours and hermetically heat seal the lid stock to the flat top lips of the trays. The sealing temperature is set on the machine panel to a value of around 120° C. The separated trays then exit the lid sealing station along the two lanes while the next carrier of four trays is then accommodated into the lid sealing station. Downstream packaging steps are carried out as known in the art. Film A used in this packaging method is a five-ply cross-linked film of structure A/B/C/B/A wherein A is a blend of 25% ethylene-vinyl acetate copolymer, 25% linear medium density polyethylene, and 50% linear low density polyethylene containing slip, antiblock, and antifog agents, C is a blend of ethylene-vinyl alcohol copolymer and a polyamide, and B is a tie layer comprising a modified linear low density polyethylene. The film is prepared by following substantially the same procedure described in Example 1 of EP-B-217,596. The film thus obtained is then submitted to a heat treatment by passing the tubular flattened film through a processing unit consisting of 6 stainless steel rollers heated to a temperature of between 70° C. and 90° C. and two rollers cooled to about room temperature, at a constant speed, for a total heating time of about 1.6 seconds. The thus obtained film which has an overall thickness of 25 micrometers, has a maximum transverse shrink force of 0.043 kg/cm. The % free shrink at the sealing temperature is about 50% in both directions.

The advantages reached with the use of the process of the invention are that the obtained barrier package has a tray lidding only 25 micrometers thick (while the conventional laminate lidding are much thicker), the lid is very tight on top of the tray with a very good control of possible ballooning effects, it is bright with very good optics (better than those obtainable with the conventional laminates also because of the reduced thickness), there is little or no distortion of the tray, and there are little or no floppy borders around the sealing area.

Analogous results can be obtained by using a Caveco Automa machine with Coopbox trays or a Caveco STL machine with injection moulded barrier polystyrene foam trays.

EXAMPLE 2

Injection moulded barrier trays about 190 mm in length, 130 mm in width, and 35 mm in depth (SOCOPA) comprising an EPS substrate with a liner of ethylene-vinyl alcohol copolymer as the barrier layer and a polyethylene heat-sealing layer (overall thickness about 7 mm), are used on a MECAPLASTIC machine (MECA 2001) suitably modified so as to provide for the cutting of the lidding film immediately after sealing. The trays are put on the infeed conveyor and filled with the products to be packaged. The machine is a 3-lane one, able to seal 3 trays per cycle and running at a speed of 10 cycles per minute.

The trays are then carried into the lid sealing station.

Film A is used and the process is run as in Example 1 with the only difference that first the heated platen descends to heat seal the lidstock to the flat top lips of the trays and immediately after a series of knives provides for the cutting of the heat-shrinkable lidstock about 3 mm far from the tray contours.

The same advantages indicated above are obtained.

EXAMPLE 3

The process is repeated on the same machine using injection moulded EPS gas permeable trays with a polyethylene heat-sealing layer (overall thickness of about 7 mm) and a Film B, 15 micrometers thick, having a three-layer structure A/B/A wherein A is a three component blend of 25% ethylene-vinyl acetate copolymer, 25% linear medium density polyethylene, and 50% linear low density polyethylene containing slip, antiblock, and antifog agents, and B is a linear low density polyethylene. Said Film B, which is cross-linked, is prepared substantially as described in U.S. Pat. No. 4,551,380, transverse direction of 0.049 kg/cm and a maximum shrink force in the longitudinal direction of 0.03 kg/cm. The % free shrink in both directions at the sealing temperature is about 60. Unlike Examples 1 and 2, in this case The same advantages indicated in Example 1 are obtained.

What is claimed is:

1. A packaging method comprising:

a) providing a tray with heat-sealable rims;

b) loading said tray with a product to be packaged;

c) applying a heat-sealable lid on top of the tray, the lid comprising a biaxially oriented heat-shrinkable film having a maximum shrink force, measured at the temperature in the lid sealing station during sealing, of 0.05 kg/cm in at least the transverse direction; and (d) heat-sealing said lid to the tray rims.

2. The method of claim 1 wherein the biaxially oriented heat-shrinkable film has a maximum shrink force, measured at the temperature in the lid sealing station during sealing, of 0.04 kg/cm.

3. The method of claim 2 wherein the biaxially oriented heat-shrinkable film has a maximum shrink force, measured at the temperature in the lid sealing station during sealing, of 0.03 kg/cm.

4. The method of claim 1 wherein the tray is thermoformed or injection moulded.

5. The method of claim 1 wherein the biaxially oriented heat-shrinkable film has a thickness of between 14 and 40 micrometers.

6. The method of claim 1 wherein the biaxially oriented heat-shrinkable film has a free shrink, measured at the temperature in the lid sealing station during sealing, of at least 10% in at least the transverse direction.

7. The method of claim 1 wherein a modified atmosphere is introduced between said lid and said tray.

8. The method of claim 1, wherein the film has a maximum shrink force, measured at 120° C., of 0.05 kg/cm in at least the transverse direction.

9. The method of claim 1, wherein the film has a maximum shrink force, measured at 120° C., of 0.04 kg/cm in at least the transverse direction.

10. The method of claim 1, wherein the film has a maximum shrink force, measured at 120° C., of 0.03 kg/cm in at least the transverse direction.

11. A package comprising:

a) a product;

b) a tray in which the product is placed, the tray having heat-sealable rims; and c) a lid heat-sealed to the tray rims, wherein the lid comprises a biaxially oriented heat-shrinkable film having a maximum shrink force of 0.05 kg/cm in at least the transverse direction.

12. The package as in claim 11 wherein the biaxially oriented heat-shrinkable film has a maximum shrink force of 0.04 kg/cm in at least the transverse direction.

13. The package as in claim 11 wherein the biaxially oriented heat-shrinkable film has a maximum shrink force of 0.03 kg/cm in at least the transverse direction.

14. The package of claim 11 wherein the tray is a thermoformed or injection moulded tray.

15. The package of claim 11 wherein the biaxially oriented heat-shrinkable film has a thickness of between 14 and 40 micrometers.

16. The package of claim 11 wherein the biaxially oriented heat-shrinkable film has a free shrink of at least 10% in at least the transverse direction.

17. The package of claim 11 wherein a modified atmosphere is disposed between said lid and said tray.

18. The package of claim 11 wherein the film has a maximum shrink force, measured at 120° C., of 0.05 kg/cm in at least the transverse direction.

19. The package of claim 11 wherein the film has a maximum shrink force, measured at 120° C., of 0.04 kg/cm in at least the transverse direction.

20. The package of claim 11 wherein the film has a maximum shrink force, measured at 120° C., of 0.03 kg/cm in at least the transverse direction.

* * * * *